US005335723A

United States Patent [19]

Mouton

[11] Patent Number: 5,335,723

[45] Date of Patent: Aug. 9, 1994

[54] COMBINATION SCRATCHER-CENTRALIZER FOR WELLBORE CASINGS

[75] Inventor: David E. Mouton, Jakarta, Indonesia

[73] Assignee: Atlantic Richfield Company, Los Angeles, Calif.

[21] Appl. No.: 84,682

[22] Filed: Jun. 29, 1993

[51] Int. Cl.[5] ..... E21B 37/02

[52] U.S. Cl. ..... 166/173

[58] Field of Search ..... 166/170–176

[56] References Cited

U.S. PATENT DOCUMENTS

| | | | |
|---|---|---|---|
| 3,176,771 | 4/1965 | Claiborne et al. | 166/173 |
| 3,351,136 | 11/1967 | Nelson | 166/173 |
| 3,842,906 | 10/1974 | Paramore et al. | 166/173 X |

*Primary Examiner*—Thuy M. Bui

*Attorney, Agent, or Firm*—Michael E. Martin

[57] ABSTRACT

A combination scratcher-centralizer for use in installing casing in wellbores comprising a single piece of coiled wire or rod having a first hub part for tightly engaging the casing, a radially expanded centralizer and scratcher portion forming a helical wrap of said wire and a second hub part slidable on the casing and formed by a helical wrap of said wire. The first hub part includes serrations and/or a plurality of retaining screws provided so that the first hub part may be secured to the casing in a predetermined position to allow the expanded centralizer coil or wrap portion to undergo some elastic axial excursion during its scratching and scraping operation upon installation in a wellbore. The constricted hub part may be held in a radially expanded position during installation by a retainer engageable with spaced apart portions of the wraps of the hub part.

9 Claims, 1 Drawing Sheet

COMBINATION SCRATCHER-CENTRALIZER FOR WELLBORE CASINGS

BACKGROUND OF THE INVENTION

1. Field of the Invention

The present invention pertains to a combination wellbore scratcher and casing centralizer for use with wellbore casings to scratch or clean the wellbore wall free of drilling mud filtercake and to centralize the casing prior to cementing the wellbore annulus.

2. Background

When installing casing in wellbores for oil and gas wells, for example, it is common practice to employ devices known as wellbore scratchers which may comprise plural segments of relatively stiff, flexible wire rope or cable connected to a collar which is disposed around the casing. Other types of scratchers include those with plural wire whiskers which extend radially from a support collar, also disposed on the casing. These "scratchers" are adapted to remove drilling mud filtercake from the wellbore wall during installation of the casing so that a better cement bond is obtained between the wellbore cement and the earth formation when the cementing operation is carried out.

Separate devices known as centralizers are usually used when installing wellbore casings. A common type of centralizer is a collar comprised of longitudinally and radially extending bands or leaf spring like elements. When installed on the wellbore casing at spaced apart points, these devices are operable to centralize the casing in the wellbore to aid in providing uniform wall thickness of the cement which is eventually pumped into the annulus between the casing and the earth formation. Accordingly, plural and different types of devices are usually installed at spaced apart points on a wellbore casing as it is installed in a wellbore to accomplish the centralization and the wellbore wall cleaning or scratching operation. These separate operations which are not always effectively carried out with prior art apparatus are, with the present invention, carried out with a single, unique device which performs dual functions more effectively than many types of prior art devices.

SUMMARY OF THE INVENTION

The present invention pertains to an improved wellbore casing scratcher for cleaning the wellbore wall during installation of well casing and which also functions equally well as a casing centralizer for positioning the casing centrally or substantially concentrically in the wellbore.

In accordance with one aspect of the present invention, a combination wellbore scratcher and casing centralizer is provided which comprises a single piece of helically wound metal rod or wire which includes opposite end portions which are relatively closely wound around a wellbore casing together with an intermediate portion which is of a larger diameter and which is operable to engage the wellbore wall during installation of the casing to centralize the casing in the wellbore and to scrape or clean the surface of the wellbore to remove drilling mud and similar filtercake material from the wellbore wall so as to improve cement bonding to the earth formation.

In accordance with another aspect of the present invention, a combination wellbore scratcher and casing centralizer is provided which is comprised of a one-piece helical wire having a first end portion which is tightly wound and operable to grip the wellbore casing to remain in place while the opposite end of the helical scratcher-centralizer is free to float and deflect axially to allow the scratcher-centralizer to be easily installed while performing its intended functions.

In accordance with yet a further aspect of the present invention, there is provided a unique helical wire type casing centralizer which has an end portion comprising one or more wraps of helical wire which are tightly engageable with the casing surface and include serrations or teeth which are operable to grip the casing to prevent substantial movement of the centralizer relative to the casing during installation in a wellbore.

The above-mentioned features and advantages of the present invention, together with other superior aspects thereof, will be further appreciated by those skilled in the art upon reading the detailed description which follows in conjunction with the drawing.

DESCRIPTION OF A PREFERRED EMBODIMENT

Figure 1:
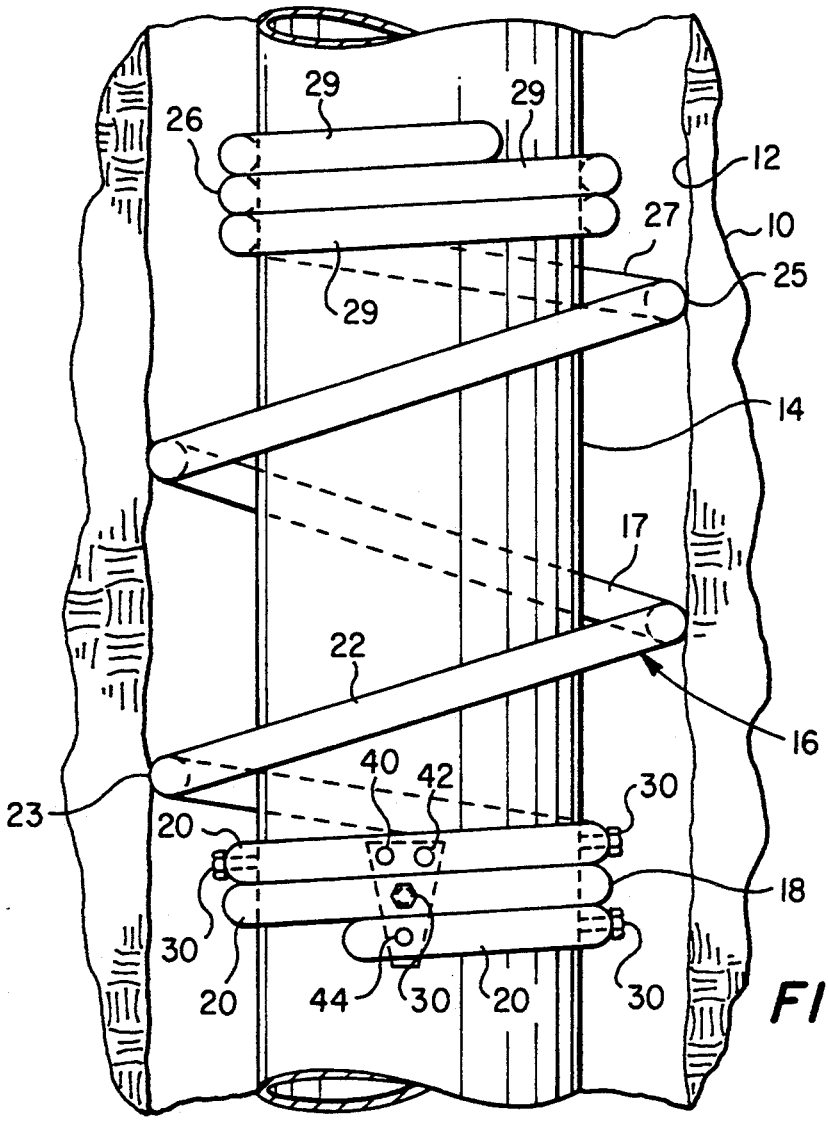
FIG. 1 is a vertical central section view of a portion of a wellbore showing the unique combination wellbore scratcher and casing centralizer of the present invention installed on a section of casing disposed in the wellbore.

In the description which follows, like parts are marked throughout the specification and drawing with the same reference numerals, respectively. The drawing figures are not necessarily to scale and certain features may be shown in somewhat schematic form in the interest of clarity and conciseness.

Referring to FIG. 1, there is illustrated a portion of an earth formation 10 in which a wellbore 12 has been formed, the wall surface of which may be coated with a filtercake or the like, not shown, from drilling fluid and forming an unstable wall surface of the wellbore. FIG. 1 illustrates a portion of a conventional wellbore casing 14 interposed in the wellbore 12 and substantially centered with respect to the central longitudinal axis of the wellbore by a unique combination wellbore scratcher and casing centralizer, generally designated by the numeral 16. The combination scratcher-centralizer 16 is characterized by a single piece of helically wrapped steel wire or rod 17, preferably formed of spring steel or the like which has a first hub part 18 made up of plural helical wraps 20 which are tightly wound on the surface of the casing 14 in gripping engagement therewith. One or more wraps of wire 20 are tightly engaged with the casing 14. Two wraps 20 are illustrated. The wire 17 is formed to curve radially outwardly into a larger diameter centralizer portion 22 which, in the exemplary centralizer 16, is engaged with the wellbore 12 over approximately one and one-half wraps of the helix. In other words, from point 23 on the expanded helix centralizer portion 22 to point 25, the expanded helix or centralizer portion 22 is in forcible engagement with the wellbore 12.

Figure 2:
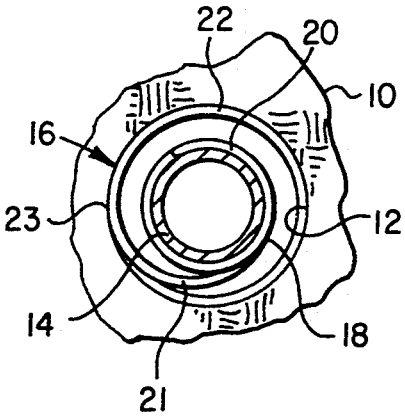
FIG. 2 is a bottom end view of the scratcher-centralizer disposed on the casing shown in FIG. 1.

The last portion of the centralizer 16 includes a hub part 26 made up of plural helical wraps 29 of the wire 17 which are relatively loosely wound around the casing 14 when they are in a relaxed condition. In other words, the hub part 26 is slidable on the casing 14 but its inner diameter is only slightly larger than the outer diameter of the casing. The configuration of the combination casing scratcher and wellbore centralizer 16 is also illustrated in the bottom end view of FIG. 2 wherein the transition portion 21 between the hub part 18 and the centralizer portion 22 is shown.

Figure 3:
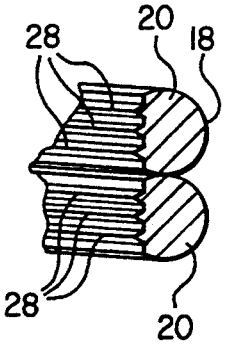
FIG. 3 is a detail view showing certain features of one end of the centralizer which are operable to forcibly grip the casing outer surface.

The centralizer 16 may be secured in a predetermined position on the casing 14 due to the unique configuration of the hub part 18. The helical wraps 20 of the hub part 18 are tightly wound so that in a relaxed condition, the inside diameter of the hub part 18 is smaller than the diameter of the casing 14. Moreover, the helical wraps 20 of the hub part 18 are preferably provided with a plurality of spaced apart circumferentially extending teeth or serrations 28, see FIG. 3, which are adapted to forcibly engage the outer surface of the casing 14 to prevent axial excursion of the centralizer 16 along the casing when it is being inserted in the wellbore 12. Alternatively, the combination scratcher-centralizer 16 may be secured in a predetermined position on the casing 14 by a plurality of retaining screws 30, see FIG. 1, which are threadedly engageable with and extend transversely through the wraps 20 of the hub part 18 to forcibly engage the casing 14 at circumferentially spaced apart points, as indicated in the drawing.

Figure 4:
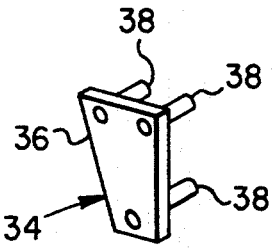
FIG. 4 is a perspective view of a retainer for use in radially expanding the coils of the end of the centralizer for installation of same on the casing.

If the scratcher-centralizer 16 depends on the constricting spring forces of the wire wraps 20 of the hub 18 together with the serrations 28 to tightly grip the casing 14, the wraps 20 must be radially expanded to a diameter slightly larger than the diameter of the casing 14 during installation of the centralizer on the casing. Accordingly, in this regard and referring to FIG. 4, a unique retainer 34 is illustrated comprising a plate member 36 having two or more spaced apart pins 38 projecting therefrom. In a preferred embodiment illustrated in FIG. 4, the retainer 34 includes three spaced apart pins 38. The pins 38 are spaced in such a way as to fit into corresponding pin receiving bores 40, 42 and 44 on the helical wraps 20 of the hub 18 to retain these wraps or coils in a radially expanded position prior to sleeving the scratcher-centralizer 16 over the casing 14. When the scratcher-centralizer 16 is in a desired position on the casing 14, the retainer 34 is removed from the bores 40, 42 and 44, allowing the coils or wraps 20 to constrict and forcibly grip the casing.

The installation of the scratcher-centralizer 16 on a casing 14 is believed to be readily understandable to those skilled in the art from the foregoing description. A sufficient number of scratcher-centralizers 16 are suitably installed on a casing string as the string is made up of individual sections of casing prior to insertion in a wellbore such as the wellbore 12. Thanks to the uncomplicated and rugged construction of the one-piece helically coiled wire scratcher-centralizer, the installation is uncomplicated, and the reliability of the dual purpose device is very high. The scratcher-centralizer may be formed of conventional spring steel or the like using conventional spring wire device forming techniques. An additional advantage of the scratcher-centralizer 16 is that the helical coil centralizer section 22, together with the transition portions of the wire or rod between the hubs 18 and 26 and the centralizer section, provide improved flow area for cement slurries in the wellbore annulus while causing some desired turbulence for cement flow as it passes over the helical coils or wraps of the centralizer.

Although a preferred embodiment of the present invention has been described in detail herein, those skilled in the art will recognize that certain substitutions and modifications may be made without departing from the scope and spirit of the invention as recited in the appended claims.

What is claimed is:

1. A combination scratcher-centralizer for use in installing casing in a wellbore for cleaning the wall of said wellbore of accumulated mud filtercake and for centralizing said casing within said wellbore comprising:

a helical coiled wire including a centralizer portion having at least a 360° helical wrap engageable with said wellbore wall to scrape said wellbore wall during installation and to centralize said casing in said wellbore; and a first hub part comprising at least one helical wrap of said wire of a diameter less than the diameter of said centralizer portion and engaged with said casing to retain said centralizer in a predetermined axial position on said casing.

2. The scratcher-centralizer set forth in claim 1 including:

means for causing said first hub part to forcibly engage said casing.

3. The scratcher-centralizer set forth in claim 2 wherein:

said means for causing said first hub part to forcibly engage said casing comprises at least one helical wrap of said first hub part having a nominal relaxed diameter less than the diameter of said casing whereby when said first hub part is sleeved over said casing, said first hub part is tightly engageable with said casing.

4. The scratcher-centralizer set forth in claim 3 including:

a plurality of circumferentially extending serrations formed on at least one helical wrap of said first hub part and forcibly engageable with said casing to retain said first hub part in a predetermined position on said casing.

5. The scratcher-centralizer set forth in claim 2 wherein:

said means for forcibly engaging said hub part with said casing comprises a plurality of retaining screws threadedly engaged with said first hub part at spaced apart points and operable for forcibly engaging said casing to retain said first hub part engaged with said casing.

6. The scratcher-centralizer set forth in claim 2 including:

a second hub part formed integral with the centralizer portion of said scratcher-centralizer and comprising at least one helical wrap of said wire.

7. The scratcher-centralizer set forth in claim 6 wherein:

said at least one helical wrap of said second hub part has an inner diameter in a relaxed condition slightly greater than the diameter of said casing whereby said second hub part and said centralizer portion are free to deflect axially relative to said first hub part during installation of said scratcher-centralizer in a wellbore.

8. The scratcher-centralizer set forth in claim 1 including:

a retainer for holding said first hub part in a radially expanded position to provide for sleeving said first hub part over said casing freely during installation of said scratcher-centralizer on a section of said casing.

9. The scratcher-centralizer set forth in claim 8 wherein:

said retainer comprises a member having at least two spaced apart pins formed thereon and engageable in corresponding pin-receiving bores formed on axially spaced portions of said first hub part to hold said helical wraps of said hub part in a radially expanded position.

* * * * *